US005845632A

United States Patent [19]

Schimmeyer

[11] Patent Number: 5,845,632

[45] Date of Patent: Dec. 8, 1998

[54] VENT DAMPER INCLUDING PIVOT POPPET

[76] Inventor: Werner K. Schimmeyer, 8937 Acorn Pl., Santa Rosa, Calif. 95409

[21] Appl. No.: 66,800

[22] Filed: Apr. 24, 1998

[51] Int. Cl.[6] ..... F23J 11/00

[52] U.S. Cl. ..... 126/307 A; 126/361; 122/17

[58] Field of Search ..... 126/307 A, 361; 122/14, 17

[56] References Cited

U.S. PATENT DOCUMENTS

| | | | |
|---|---|---|---|
| 1,991,557 | 2/1935 | Johnson | 122/14 |
| 4,259,943 | 4/1981 | Rodrigue | 126/292 |
| 4,442,798 | 4/1984 | Zanias | 122/17 |
| 4,526,160 | 7/1985 | Ickes | 126/292 |
| 4,770,160 | 9/1988 | Schimmeyer | 126/285 |
| 5,239,947 | 8/1993 | Schimmeyer | 122/17 |
| 5,732,692 | 3/1998 | Schimmeyer | 126/285 A |

*Primary Examiner*—Carroll B. Dority
*Attorney, Agent, or Firm*—Claude A. S. Hamrick; Oppenheimer W. Donnelly; Justin F. Boyce

[57] ABSTRACT

A vent damper is provided for limiting the flow of ambient air through the central core of a hot water heater having a combustion chamber, the central core forming an exhaust port leading to an exhaust duct for evacuation of exhaust gases from the combustion chamber. The vent damper includes an annular base having an upwardly facing opening forming a passageway therethrough for passage of the exhaust gases from the exhaust port to the exhaust duct. A poppet is pivotally supported above the annular base means to pivot between a closed position closing the passageway and a open position opening the passageway. The poppet is configured such that the exhaust gases generated in the combustion chamber and passing out of the exhaust port cause the poppet to pivot into the open position such that the gases may flow through the passageway. The weight of the poppet is distributed about a pivot such that in the absence of the gases, it falls under the influence of gravity into the closed position to limit the flow of ambient air through the central core. A down draft hood is disposed between the poppet and the exhaust duct to provide down draft protection. The down draft hood includes side ports to allow the gases to flow from the exhaust port to the exhaust duct when the passageway is open. The down draft hood permits operational lifting of the closure element even in a down-draft situation. A flue hood covers the down draft hood.

10 Claims, 4 Drawing Sheets

VENT DAMPER INCLUDING PIVOT POPPET

BACKGROUND OF INVENTION

1. Field of the Invention

This invention relates generally to water heating apparatus, and more particularly to an improved vent damper and flue closure for gas hot water heaters.

2. Description of the Prior Art

In gas water heaters, fuel is burned in a combustion chamber located at the base of the heating unit. Water contained in a heater tank is heated by conduction through walls of the combustion chamber where the fuel is burned, as well as by conduction through the heater's central venting passageway through which the hot combustion gases pass. These combustion gases are then exhausted via a flue, or exhaust duct.

However, even after the flame is extinguished in the combustion chamber, the heated water maintains sufficient heat in the walls forming the central passageway to induce a flow of cooler ambient air therethrough. The passage of the cooler air causes substantial energy loss as the heater water is caused to cool more rapidly than would be the case if the cool ambient air were not allowed to pass through the tank and into the exhaust duct. There exists in the prior art a number of flue dampening devices which utilize a damper valve disposed in the central venting passageway of a water heater. When the heater burner is in operation, the valve is opened to allow hot exhaust gases to escape into the exhaust duct and when the burner is off, the valve is moved into a closed position to prevent cool room air from circulating through the central venting passageway.

One type of flue dampening device includes an electrical motor for opening and closing a damper valve. One problem with such devices is that use of an electrical motor incurs expense and complexity in manufacturing of the dampening device. Another problem with such devices is reliability because an electrical power failure could cause a failure to open the valve when the heater burner is in operation which can cause flame rollout. A sensor means must therefore be provided in the wall of a heater compartment to shut off the gas after a predetermined time of flame roll out, as required by recent water heater manufacturing specifications.

In another type of flue dampening device, a damper valve is opened and closed manually. U.S. Pat. No. 4,526,160 discloses an apparatus for controlling flow of combustion products through a cylindrical furnace flue having a first axis extending in an axial direction along the flue. A generally circular shaped damper disposed in the flue is mounted for rotation about a second axis perpendicular to the first axis. A handle provides for manual rotation of the damper to variably impede the flow of combustion products through the furnace flue. The axis of rotation generally bisects the circular plane of the damper and thus flow of combustion products is permitted between the damper and inner wall of the flue on both sides of the damper when the surface of the damper is not in a closed position, that is orthogonal to the first axis along which the combustion products flow. This apparatus is not practical for use as a vent damper for a water heater because in order to meet the objectives of the present invention the damper would have to be manually opened and closed.

A more desirable type of flue dampening device includes a valve which opens in response to forces generated by hot exhaust gases flowing through the venting passageway when the heater burner is in operation and closes automatically when the burner is turned off. Applicant's prior U.S. Pat. No. 4,755,160 discloses a vent damper comprising a frusto-conical shaped floating poppet closure that is slidably mounted on a guide within a flue hood immediately above the heater. When the heater burner is in operation, the hot exhaust gases lift the poppet allowing the gases to escape around the poppet and into the flue. When the main burner is off, the poppet lowers into a closed position where it rests atop the tank's central passageway and prevents the cool room air from circulating therethrough. Although the poppet closure provides a substantial improvement over other prior art devices, the shape of the poppet makes it expensive to manufacture, and frictional engagement to its guide sometimes affects its reliability.

Applicant's prior U.S. Pat. No. 5,239,947 discloses another form of a vent damper having an annular closure element that is slidably engaged to a cylindrical inner guide including a plurality of legs with each leg having a ridge raised in relief on the outside of the leg and continuing along the length thereof. A central baffle supported by the legs directs the exhaust in a generally streamlined flow direction. An annular down draft deflector shield is attached to the upper end of the guide and serves to direct down drafts outwardly of the closure element. A cylindrical outer housing attached to the deflector shield rests atop the water heater tank top and supports the inner shell, support legs and closure assembly. The annular closure element is constructed from light weight material (e.g., aluminum foil) and slides upwardly along the cylindrical inner guide in response to forces generated by hot combustion gases rising through the central core of the heater when the water heater main burner is on, and returns to its closed position under its own weight when the burner is turned off. One problem with this design is that the light weight material of the closure element is somewhat fragile and can be easily damaged during shipping or installation.

Another prior art flue dampening device includes a more robust valve having a spring loaded "flapper" which opens in response to forces generated by exhaust gases flowing through the venting passageway. However, these devices normally require a significant flow of exhaust in order to open, and thus are used mostly with heating units having a fan or blower which drives exhaust gases through the exhaust duct. One particular such device includes a hinged, spring-loaded, one-way mechanical valve that prevents outside air from passing through the exhaust duct when the fan or blower is not operating.

What is needed is an improved vent damper apparatus which is relatively inexpensive to make yet is highly reliable in operation, and includes a damper valve which opens smoothly in response to forces generated by exhaust gases flowing through the venting passageway without the assistance of a fan or blower and closes when the flow of exhaust gases is terminated. What is also needed is an improved vent damper apparatus that permits operational lifting of the closure element even in a downdraft situation. There is also a further need for an improved vent damper apparatus that can be used on either 3" or 5" exhaust ports.

SUMMARY OF THE INVENTION

It is therefore a primary objective of the present invention to provide an improved vent damper apparatus which is relatively inexpensive to make, yet is highly reliable in operation, having a resilient damper valve which opens and closes smoothly in response to the presence and lack of forces generated by exhaust gases flowing through the venting passageway without the assistance of a fan or blower.

Another objective of the present invention is to provide a damper apparatus having a closure element that is substantially less fragile than those of my above mentioned prior designs.

Still another objective of the present invention is to provide an apparatus of the type described that permits operational lifting of the closure element even in a down-draft situation.

A further objective of the present invention is to provide a single improved vent damper apparatus that can be used on either a 3" or 5" exhaust port.

Briefly, a preferred embodiment of the present invention provides a vent damper apparatus for limiting the flow of ambient air through the central core of a hot water heater having a combustion chamber, the central core forming an exhaust port leading to an exhaust duct for evacuation of exhaust gases from the combustion chamber. The vent damper includes an annular base assembly having an upwardly facing opening forming a passageway therethrough for passage of the exhaust gases from the exhaust port to the exhaust duct. A closure means is pivotally supported above the annular base assembly to pivot between a closed position closing the passageway and an open position opening the passageway. The closure means is configured such that the exhaust gases generated in the combustion chamber and passing out of the exhaust port cause the closure means to pivot into the open position such that the gases may flow through the passageway. The weight of the closure means is distributed about a pivot such that in the absence of the gases, it falls under the influence of gravity into the closed position to limit the flow of ambient air through the central core.

A down draft hood means is disposed between the closure means and the exhaust duct to provide down draft protection for the closure means. The downdraft hood means includes side ports formed through side walls thereof to allow the exhaust gases to flow therethrough as they pass from the exhaust port to the exhaust duct when the closure means is in the open position. A flue hood means covers the down draft hood means and provides a support for the exhaust duct.

In the disclosed embodiment, the closure means includes a poppet having a generally dome shaped portion surrounded by an annular flange portion, and a hinge plate attached to the annular flange in cantilevered fashion and deformed at a distal end thereof to form a transversely extending inverted V-shaped pivot channel. A transversely extending fulcrum is provided at the top of the base means, and is adapted to be engaged by the pivot channel. The pivot channel is positioned relative to the cover portion so that approximately ⅔ of the poppet is disposed to one side of the pivot channel and approximately ⅓ of the poppet is disposed to an opposite side of the pivot channel. A resilient spring clip is used to captivate the pivot channel to the fulcrum.

The annular base means includes an annular step having a plurality of inner slots each formed therethrough at a first radial distance from the center of the annular step, and a plurality of outer slots each formed therethrough at a second radial distance from the center of the annular step. In this embodiment, the down draft hood includes a plurality of tabs extending from its bottom extremity for insertion into one of the plurality of inner slots formed in the annular step, and the flue hood includes a plurality of elongated legs each having a tab extending from a lower extremity thereof for insertion into one of the plurality of outer slots.

In this embodiment, the opening in the base means is a D-shaped aperture opening formed through a top surface of the base means. The vent damper further includes a short chimney having a substantially D-shaped cross section adapted to be inserted into the D-shaped opening in the base. The planar side of the chimney has an edge forming the transversely extending fulcrum.

An important advantage of the present invention is that it provides a reliable means for restricting the flow of air through the central core of a gas heater tank at a time when no heat is being applied, thus conserving the heat within the tank.

Another important advantage of the present invention is that the damper valve pivots to open and close smoothly in response to forces generated by exhaust gases flowing through the venting passageway.

These and other objects and advantages of the present invention will no doubt become apparent to those skilled in the art after having read the following detailed description of the preferred embodiments.

IN THE DRAWING

FIG. 1 is a partially cutaway side view illustrating generally a vent damper assembly of the present invention, including a flue hood and down draft hood having side ports formed therethrough, wherein the vent damper is installed between an exhaust port at the top of a gas-fired hot water heater and an exhaust duct;

FIG. 2 is a partially cutaway side view depicting the vent damper assembly of FIG. 1 wherein the flue hood and down draft hood are partially broken to better illustrate components of the preferred embodiment including a damper base having an opening forming a passageway between the exhaust port and interior of the down draft hood, a chimney extending upward from the base for pivotally supporting a poppet which pivots between an open position wherein the passageway is open to allow hot exhaust gases to escape into the down draft hood and a closed position wherein the passageway is closed position to prevent cool air from circulating through the exhaust port;

DETAILED DESCRIPTION OF THE PREFERRED EMBODIMENTS

Figure 1:
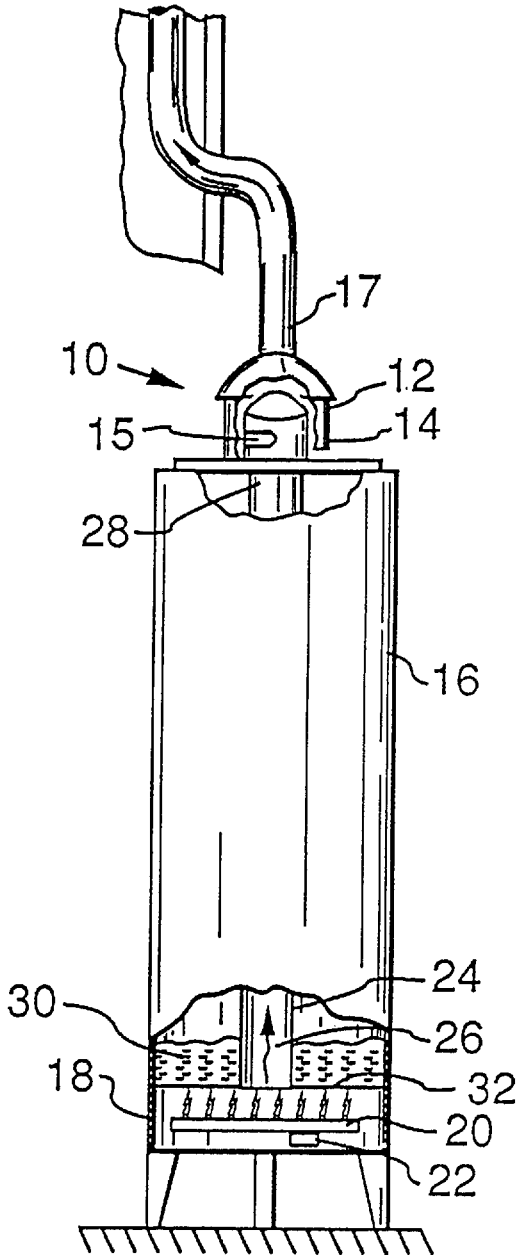

FIG. 1 shows a partially cutaway side view of a vent damper assembly 10 according to the present invention mounted to the top of a water heater and including a flue hood 12 disposed over a down draft hood 14 having side ports 15 formed therethrough. The damper assembly is installed upon a hot water heater 16 and disposed beneath an exhaust duct 17 commonly used with water heaters. The water heater 16 includes a combustion chamber 18 which contains a main burner 20 and a pilot light 22, together with a central core 24 forming an exhaust passageway 26 that terminates at its upper axial extremity 28 in an exhaust port. A water tank 30 having a water tank base 32 surrounds the core 24. Natural gas or propane is normally burned in the combustion chamber 18 to heat the water in the tank 30 via conduction through the base 32 and core 24 of the water tank. The exhaust gases exit the top of the heater at the exhaust port 28, pass through the side ports 15 of the down draft hood to the interior of the flue hood 12, and out to the outside air through the exhaust duct 17 that is attached to the top of the flue hood. The down draft hood 14 protects interior components of the vent damper 10 from down drafts entering via the exhaust duct 17 as further explained below.

Figure 2:
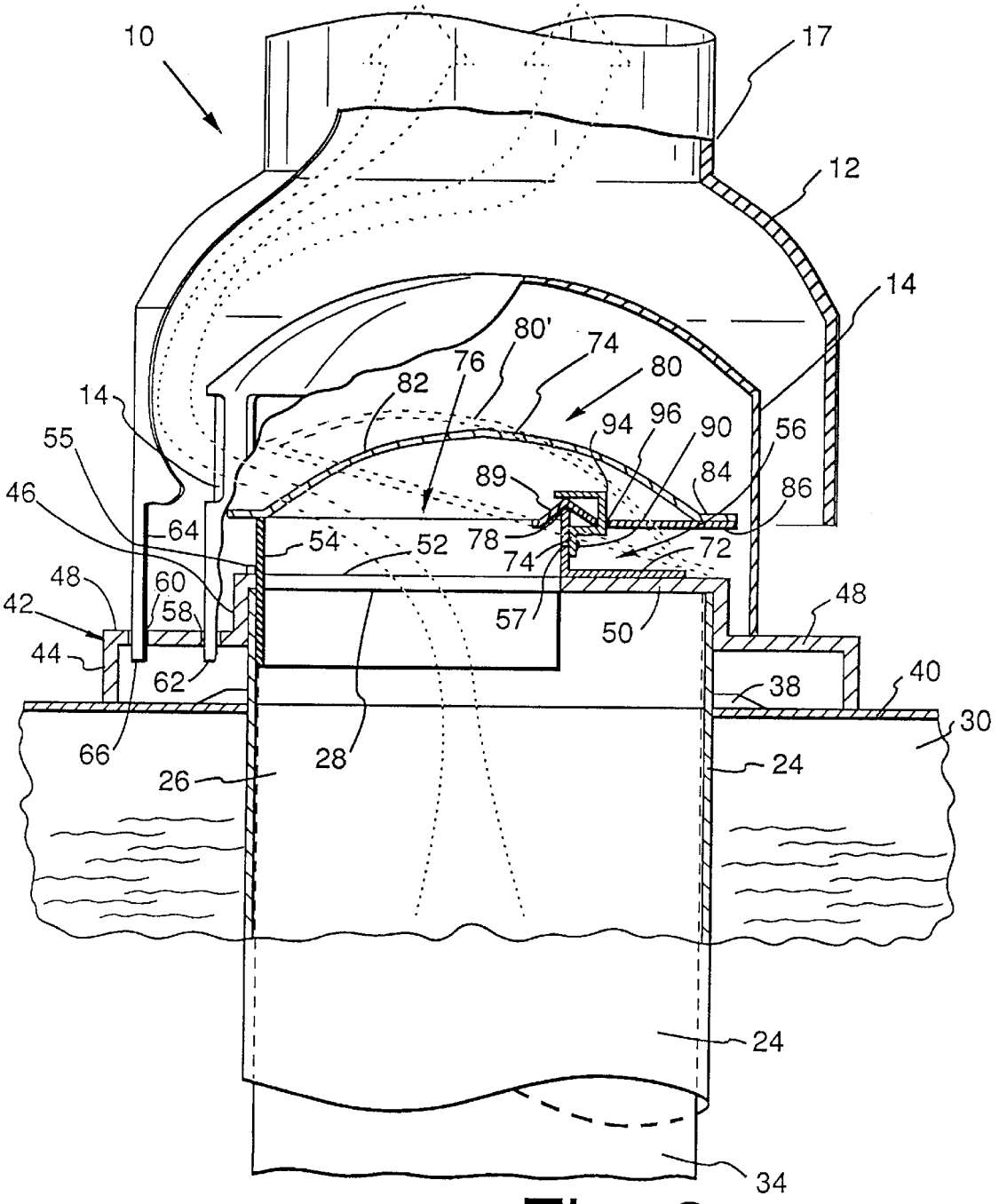

FIG. 2 shows a partially cut away side view of the vent damper assembly, showing the flue hood 12 and down draft hood 14 partially broken to reveal components of a preferred embodiment. The central core 24 of water heater 16 is also shown partially broken to reveal a baffle 34 disposed within the central core and extending in a vertical direction parallel to the longitudinal axis of the core from the water tank base 32 (FIG. 1) to the exhaust port 28. The baffle 34, which is standard equipment in typical water heaters, includes a pair of tabs (not shown) extending in a direction normal to the axis of the central core for insertion into slots (not shown) formed along the inner walls of the central core. The baffle provides for uniform flow of exhaust gases through the exhaust passageway 26. A retainer ring 38, shown in cross section, is disposed about the central core 24 and over a top surface 40 of the water tank 30 to hold the central core 24 in place.

The damper assembly includes an annular damper base 42 disposed over the central core 24 and over the retainer ring 38, and has a lower axial section 44 and an upper axial section 46. The lower axial section has a cylindrical cross section which is larger than the cross section of the upper axial section and the upper and lower axial sections 46 are disposed in a generally coaxial relationship with the central core 24. An open end of the lower axial section 44 is disposed on the top surface 40 of the water heater. The damper base 42 includes an annular shaped step 48 fixed between the lower and upper axial sections 44 and 46, and the upper extremity of section 44 is partially closed to form a platform 50. Platform 50 has an upwardly facing generally D-shaped opening 52 formed therethrough for receiving a shell 54 which has the shape of a partial cylinder.

The dimensions and positioning of the base 42, opening 52, and shell 54 are adapted so that a top axial section of the of the central core 24, extending upward from the surface 40 of the water tank, fits between the upper axial section 46 of the base and the shell 54 in a generally coaxial relationship. In the preferred embodiment, the dimensions and positioning of the base 42, opening 52, and shell 54 are adapted to accommodate the dimensions of the top axial section of the central core 24 of standard water heaters. A tab 55 extends in a radial direction outward from a position on the outer wall of the damper shell 54, and is supported by the platform 50 of the base thereby providing support for the damper shell 54. The damper shell 54 includes a slit (not shown), extending in an axial direction from its lower extremity to a point slightly below the tab 55, for receiving a top section of the baffle 34 which is disposed within the central core 24. As described futher below, the slit is positioned to align the baffle 34 with the opening 52 in a positional relationship which optimizes uniform flow of exhaust gases through the opening 52. The depth to which the shell 54 extends into the opening 52 is fixed and maintained by the tab 55, the slit (not shown), the baffle 34, and a closure support element 56 which is fixed to the platform 50 and the shell 54 as further explained below.

The annular step 48 of the damper base has a plurality of inner slots 58 each of which is formed therethrough at a first radial distance from the center of the lower axial section 44, and a plurality of outer slots 60 each of which is formed through the annular step 48 at a second radial distance from the center of the lower axial section. In the depicted embodiment, each of the inner slots 58 and outer slots 60 is positioned 120 degrees apart from the remaining inner slots 58 and outer slots 60 respectively.

The down draft hood 14 includes a plurality of tabs 62 extending from a bottom axial extremity for insertion into one of the plurality of inner slots 58 formed in the annular step. A plurality of elongated legs 64 extend from a bottom open end of the flue hood 12, each of the legs 64 having a tab 66 extending from a lower extremity thereof for insertion into one of the plurality of outer slots 60 formed in the annular step.

The closure support element 56, disposed over the platform 50 of the base, includes: a foot member 72 adapted to be fixed to the surface area of the platform 50; a vertically extending planar member 74 extending upward in a direction substantially orthogonal to the surface of the platform 50, and forming a wall for closing off the open side of the partial-cylindrically shaped shell 54 to form a chimney 76; and a pair of tabs (not shown) extending from the side edges of the planar member 74 in a direction tangential to the circumference of the shell 54 for allowing the support element 56 to be affixed to the shell 54 as further explained below. The planar member 74 extends upwardly to a height such that its distal edge is disposed a small distance above the top axial extremity of the shell 54 to form a transversely extending fulcrum 78 for pivotally supporting a poppet 80 above the chimney 76.

The poppet 80 includes: a substantially dome shaped cover portion 82; an annular flange portion 84 formed integral with cover portion 82 in a surrounding relationship; and a pivot plate 86 attached at one end to the annular flange 84, and deformed at a distal edge thereof to form a transversely extending inverted V-shaped pivot channel 89 for engaging the transversely extending fulcrum 78. In the preferred embodiment, plate 86 is tack welded to the annular flange 84 of the poppet 80.

The planar member 74 of the closure support element 56 includes a threaded hole 57 formed therein to receive a screw 90 for affixing a resilient spring clip 94 thereto. The plate 86 includes a slot 96 formed therethrough for receiving the spring clip 94, the clip being used to hold the pivot channel 89 over and in engagement with the transversely extending fulcrum 78. If the poppet 80 incurs an excessive upward force tending to cause the poppet pivot bar to lift off of the pivot bar, the spring clip serves to retain the poppet pivot in its proper position as shown. The clip 94 is adapted not to touch the cover portion 82 of the poppet so as not to interfere with the pivoting of the poppet.

A passageway is formed between the open top end of the chimney 76 and the interior of the down draft hood 14. The poppet 80 pivots over the top of the chimney between a closed position closing the passageway and an open position opening the passageway. The poppet is configured such that the exhaust gases generated in the combustion chamber (FIG. 1) and passing out of the exhaust port 28 through the chimney cause the poppet 80 to move into the open position (indicated by dashed lines 80') such that the gases may flow through the side ports 15 of the down draft hood 14 and into the exhaust duct 17. The weight of the poppet is distributed about the inverted V-shape pivot channel 89 such that in the absence of the exhaust gases, the poppet falls under the influence of gravity back into the closed position to limit the flow of ambient air through the central core 24.

In the preferred embodiment, the cross sectional area of the chimney 76 is approximately ⅔ of the cross sectional area of the central core. This is possible because the exhaust gas rising from the combustion chamber 18 (FIG. 1) is reduced in volume due to cooling of the exhaust gas as it passes through the central core 24. In the preferred embodiment, the pivot channel 89 is positioned so that approximately ⅔ of the dome shaped cover 82 is disposed to one side of the pivot channel and approximately ⅓ of the cover is disposed to the opposite side of said pivot channel. The portion of the plate 86 between the pivot channel 89 an allowing the poppet 80 to pier weight allowing the poppet 80 to pivot in response to a small force generated by exhaust gases flowing upward from the exhaust port 28. The effective weight of the cover portion must be very small because the lifting force of the exhaust gases during the heating cycle is very small. The pivoting mechanism provided by the inverted V-shaped pivot channel 89 and transversely extending fulcrum 78 is preferred over a hinge mechanism, having a pin inserted through a tubular opening, because a hinge mechanism could accumulate debris such as rust from the heat baffle or central core and restrict the pivoting action of the hinge. The likelihood of corrosion hang up is minimized because the maximum opening resistance is 1–3 grams.

The down draft hood 14 provides protection from a draft down force from the exhaust duct 17 which would keep the poppet 80 from opening, or even close it during the heating cycle of the water heater 16 (FIG. 1). A down draft force incident on the top of the down draft hood creates a reduction in pressure under the down draft hood allowing the poppet 80 to freely open in response to forces generated by the exhaust gases generated in the combustion chamber during the heating cycle of the water heater even though the down draft is present.

Figure 3:
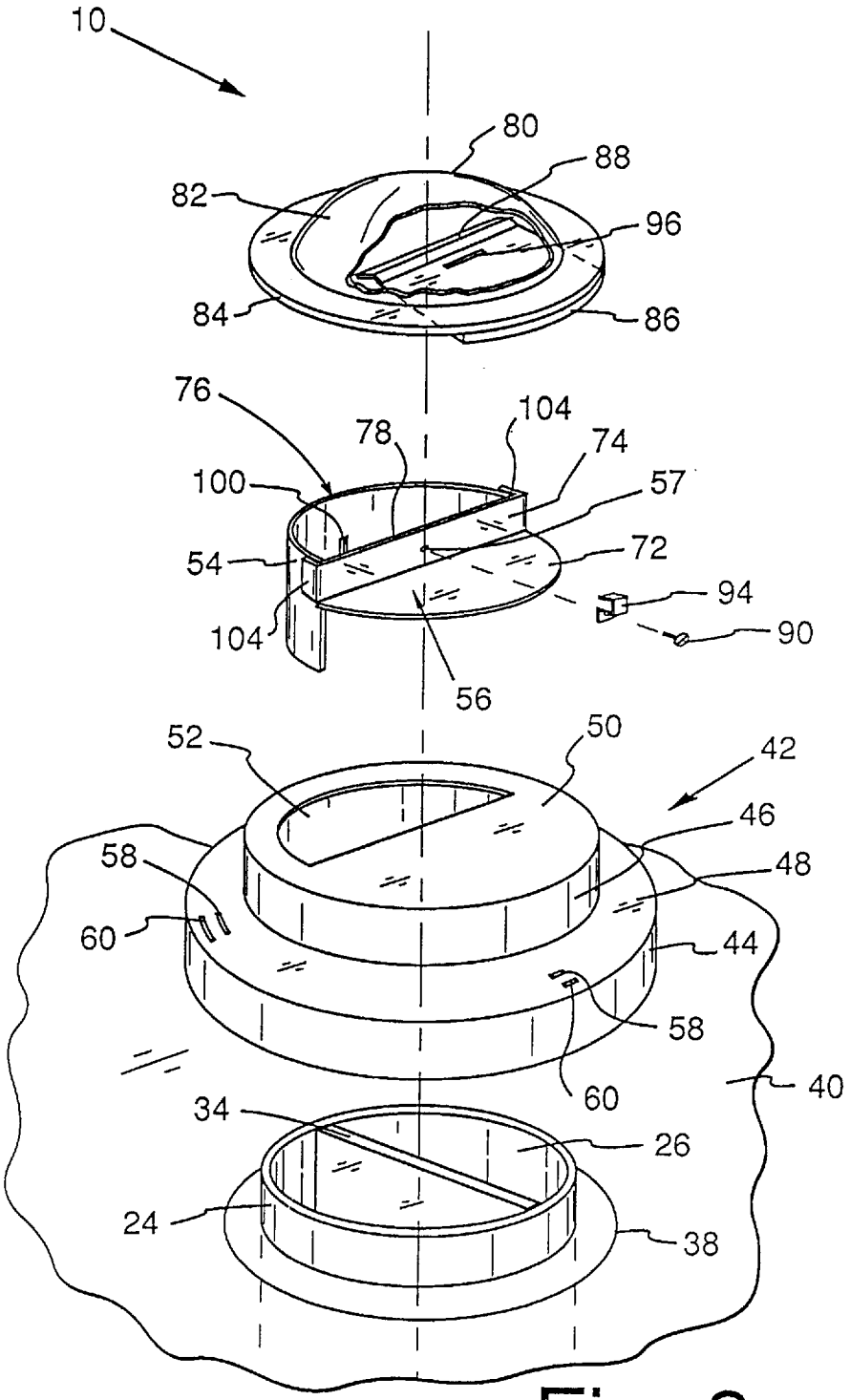
FIG. 3 is an exploded perspective view of components of the vent damper assembly of FIG. 2 including the damper base, damper shell, closure support element, and poppet.

FIG. 3 is an exploded perspective view showing further details of components of the vent damper assembly of FIG. 2 including the damper base 42, chimney 76, and poppet 80. The depicted view shows the slit at 100 extending in an axial direction from the lower axial extremity of the shell 54 for receiving the top section of the baffle 34 disposed within the central core 24. As mentioned, the slit is positioned to align the baffle 34 with the D-shaped opening 52 in a positional relationship which optimizes uniform flow of exhaust gases through the opening 52. Specifically, the slit 100 is positioned so that the transversely extending fulcrum 78 is disposed substantially orthogonal to the transverse axis of the baffle 34 when the vent damper 10 is properly installed onto the water heater 16 (FIG. 1). During installation of the vent damper 10 onto the water heater, the base 42 must be rotated until the slit 100 at the lower axial extremity of the shell 54 engages the top section of the baffle 34. With the transversely extending fulcrum 78 disposed orthogonal to the transverse axis of the baffle 34, the upward flow of exhaust gas from the exhaust port 28 is made more uniform so that the force which the flowing gas exerts on the poppet 80 is balanced.

The depicted view also shows the threaded hole 57 formed in the planar member 74 of the closure support element 56 for receiving the screw 90 (FIG. 2) for fixing the spring clip 94 to the planar member 74. Further shown is the pair of tabs 104 extending from the edges of planar member 74 in the direction tangential to the circumference of the shell 54. In the preferred embodiment, the tabs 104 are spot welded to the shell 54.

Figure 4:
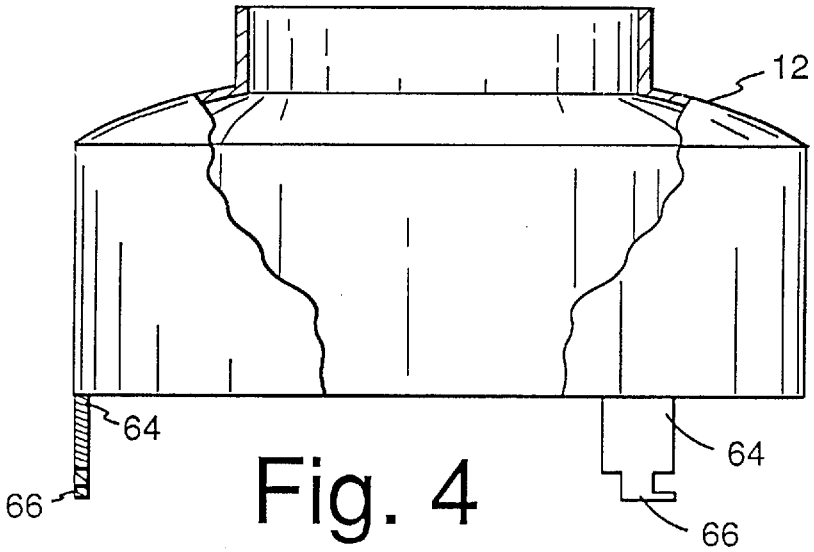
FIG. 4 is a partially cutaway side view of the flue hood of FIG. 2.

FIG. 4 is a partially cutaway side view of a preferred embodiment of the flue hood 12 of FIG. 2. The depicted the flue hood 12 includes three of the plurality of elongated legs 64 extending from the bottom open end of the flue hood 12, each having a tab 66 extending from an axial extremity thereof for insertion into one of the plurality of outer slots 60 formed in the annular step. Two of the legs 64 are shown while the third is obscured from view.

Figure 5:
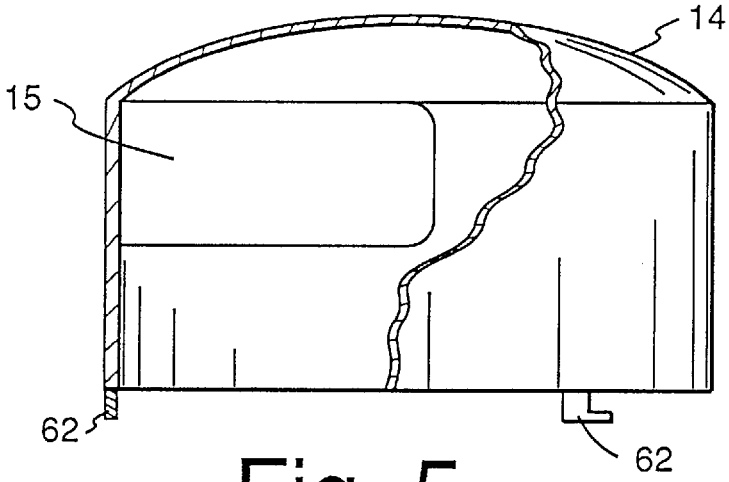
FIG. 5 is a partially cutaway side view of the down draft hood of FIG. 2.

FIG. 5 is a partially cutaway side view of a preferred embodiment of the down draft hood 14 of FIG. 2. The depicted down draft hood 14 includes the tabs 62 extending from the bottom axial extremity for insertion into one of the inner slots 58 formed in the annular base (FIG. 3). Two of the tabs 62 are shown while the third is obscured from view. The depicted down draft hood 14 includes two side ports 15.

Although the present invention has been described in terms of specific embodiments, it is anticipated that alterations and modifications thereof will no doubt become apparent to those skilled in the art. It is therefore intended that the following claims be interpreted as covering all such alterations and modification as fall within the true spirit and scope of the invention.

I claim:

1. A vent damper for limiting the flow of ambient air through the central core of a hot water heater having a combustion chamber, said central core forming an exhaust port leading to an exhaust duct for evacuation of exhaust gases from said combustion chamber, comprising:

annular base means having an upwardly facing opening forming a passageway therethrough for passage of said exhaust gases from said exhaust port to said exhaust duct;

closure means pivotally supported above said annular base means to pivot between a first position closing said passageway and a second position opening said passageway, said closure means being configured such that said exhaust gases generated in said combustion chamber and passing out of said exhaust port cause said closure means to pivot into said second position such that said gases may flow through said passageway, the weight of said closure means being distributed about a fulcrum such that in the absence of said gases, said closure pivots under the influence of gravity into said first position to limit the flow of ambient air through said central core;

first hood means disposed between said closure means and said exhaust duct to provide down draft protection for said closure means, said first hood means having side ports formed through side walls thereof to allow said exhaust gases to flow from said exhaust port to said exhaust duct when said closure means is in said second position; and second hood means covering said first hood means and providing a support for said exhaust duct.

2. A vent damper as recited in claim 1 wherein said closure means includes a generally dome shaped cover portion.

3. A vent damper as recited in claim 1 wherein said closure means includes a generally dome shaped cover portion surrounded by an annular flange portion.

4. A vent damper as recited in claim 3 further including:

a hinge plate attached to said annular flange portion and deformed at a distal end thereof to form a transversely extending inverted V-shaped pivot channel; and a transversely extending fulcrum disposed above said base means, and adapted to be engaged by said pivot channel.

5. A vent damper as recited in claim 4 further including a resilient spring clip for captivating said pivot channel to said fulcrum.

6. A vent damper as recited in claim 4 wherein said pivot channel is positioned so that approximately ⅔ of said cover is disposed to one side of said pivot channel and approximately ⅓ of said cover is disposed to an opposite side of said pivot channel.

7. A vent damper as recited in claim 1 wherein said annular base means further includes:

an annular step having, a plurality of N inner slots each formed therethrough at a first radial distance from the center of said annular step, and a plurality of N outer slots each formed therethrough at a second radial distance from said center of said annular step;

wherein said down draft hood includes a plurality of tabs extending from its bottom axial extremity for insertion into one of said plurality of inner slots formed in said annular step;

wherein said flue hood includes a plurality of elongated legs each having a tab extending from an axial extremity thereof for insertion into one of said plurality of outer slots formed in said annular step.

8. A vent damper as recited in claim 7 wherein N=3 and wherein:

said inner slots are disposed approximately 120 degrees apart; and said outer slots are disposed approximately 120 degrees apart.

9. A vent damper as recited in claim 1 wherein said opening in said base means is a D-shaped opening formed through a top surface of said base means, and wherein said central core includes a baffle disposed therein extending along the longitudinal axis of said central core to a height proximate to said exhaust port, said vent damper further including:

a chimney having a substantially D-shaped cross section adapted to be inserted into said D-shaped opening, said chimney having a slit extending in an axial direction from its lower extremity for receiving a top edge of said baffle; and a planar member supported above said chimney and having an upper distal edge forming a transversely extending fulcrum, said slit being positioned so that said fulcrum is disposed substantially orthogonal to said baffle.

10. A vent damper as recited in claim 9 wherein said closure means includes:

a generally dome shaped cover portion surrounded by an annular flange portion; and a hinge plate attached to said annular flange portion and deformed at a distal end thereof to form a transversely extending inverted V-shaped pivot channel for engaging said fulcrum.

* * * * *